US011155938B2

(12) United States Patent
Shibuya

(10) Patent No.: US 11,155,938 B2
(45) Date of Patent: Oct. 26, 2021

(54) WIRE STRANDING APPARATUS AND METHOD FOR MANUFACTURING STRANDED WIRE

(71) Applicant: NITTOKU CO., LTD., Saitama (JP)

(72) Inventor: Nao Shibuya, Nagasaki (JP)

(73) Assignee: NITTOKU CO., LTD., Saitama (JP)

( * ) Notice: Subject to any disclaimer, the term of this patent is extended or adjusted under 35 U.S.C. 154(b) by 0 days.

(21) Appl. No.: 16/647,009

(22) PCT Filed: Sep. 25, 2018

(86) PCT No.: PCT/JP2018/035471
§ 371 (c)(1),
(2) Date: Mar. 12, 2020

(87) PCT Pub. No.: WO2019/106925
PCT Pub. Date: Jun. 6, 2019

(65) Prior Publication Data

US 2020/0277713 A1 Sep. 3, 2020

(30) Foreign Application Priority Data

Nov. 30, 2017 (JP) ..... JP2017-230293

(51) Int. Cl.
*D01H 1/14* (2006.01)

(52) U.S. Cl.
CPC ..... *D01H 1/14* (2013.01)

(58) Field of Classification Search
CPC ..... D01H 1/14
USPC ..... 57/3
See application file for complete search history.

(56) References Cited

U.S. PATENT DOCUMENTS 3,178,878 A * 4/1965 Brown ..... F16F 15/22 242/439.5
3,393,503 A * 7/1968 Lucas ..... B65B 67/08 57/94
3,572,024 A * 3/1971 Lyons ..... H01B 13/0257 57/3
3,590,567 A * 7/1971 Bonikowski ..... B65H 23/044 242/421.7

(Continued)

FOREIGN PATENT DOCUMENTS

DE 1047678 B * 12/1958 ..... D07B 7/02
DE 2831604 A1 * 1/1980 ..... D07B 3/06

(Continued)

*Primary Examiner* — Khoa D Huynh
*Assistant Examiner* — Grace Huang
(74) *Attorney, Agent, or Firm* — Rabin & Berdo, P.C.

(57) ABSTRACT

A wire stranding apparatus, comprising: a core wire moving mechanism configured to move a core wire in an axial direction; a spool configured to feed a wound wire by rotation; a revolving mechanism configured to revolve the spool about the core wire; a rotation driving mechanism configured to feed the wire by rotating the spool, the wire fed from the spool being spirally wound on an outer periphery of the core wire moving in the axial direction by revolution of the spool; and a control device including a wire speed obtaining unit configured to obtain a speed of the wire to be wound on the core wire and a rotation driving mechanism control unit configured to control the rotation driving mechanism such that the speed of the wire obtained by the wire speed obtaining unit has a predetermined value.

4 Claims, 6 Drawing Sheets

(56) References Cited

U.S. PATENT DOCUMENTS 3,659,802 A * 5/1972 Agonis ..... B21C 47/20 242/128
3,902,308 A * 9/1975 Bernstein ..... D01H 13/145 57/265
3,975,980 A * 8/1976 Hood ..... D07B 5/005 87/6
4,309,864 A * 1/1982 Hulin ..... G02B 6/4489 57/352
4,320,619 A * 3/1982 Allard ..... B65H 57/20 242/128
4,497,164 A * 2/1985 Dotti ..... G02B 6/4489 57/6
4,519,197 A * 5/1985 Borroni ..... B65H 49/34 57/64
4,549,391 A 10/1985 Toda et al.
4,574,574 A * 3/1986 Knaak ..... B65H 59/387 242/420.4
4,612,759 A * 9/1986 Meijer ..... H01B 13/26 242/439.6
4,628,675 A * 12/1986 Sakamoto ..... H01B 13/0841 57/3
4,628,676 A * 12/1986 Lepach ..... B65H 67/04 57/266
4,640,086 A * 2/1987 Levino ..... B29C 63/105 242/439.5
4,663,928 A * 5/1987 Delobel ..... H01B 13/26 57/264
4,709,542 A * 12/1987 Krafft ..... D07B 3/045 57/13
4,807,430 A * 2/1989 Palmer ..... D02G 3/365 57/100
4,896,494 A * 1/1990 Cholley ..... H01B 13/0235 57/13
5,038,458 A * 8/1991 Wagoner ..... H05B 3/56 29/593
5,060,467 A * 10/1991 Gill ..... G02B 6/4491 57/13
5,321,356 A * 6/1994 Weischedel ..... G01N 27/82 324/262
5,632,136 A * 5/1997 Luchenbill ..... B65H 75/14 242/441.4
5,729,966 A * 3/1998 Grulick ..... G02B 6/4482 385/147
6,062,506 A * 5/2000 Eck ..... B65H 54/103 242/473.5
6,209,299 B1 * 4/2001 Landry ..... D07B 3/10 174/11 OR
6,223,511 B1 * 5/2001 Brazeau ..... B65H 59/384 57/13
6,260,342 B1 * 7/2001 Lehman ..... A41G 1/04 428/10
6,318,062 B1 * 11/2001 Doherty ..... D07B 3/10 57/206
6,324,872 B1 * 12/2001 Blaszyk ..... C03B 37/03 65/504
6,449,937 B1 * 9/2002 Galan I Llongueras ..... D02G 3/06 428/15
7,370,823 B2 * 5/2008 Lammermann .... B65H 54/2878 242/397.2
7,520,120 B2 * 4/2009 Saito ..... H01B 13/0866 57/10
8,129,294 B2 * 3/2012 Khokar ..... D02G 3/06 442/186
8,161,722 B2 * 4/2012 Chiasson ..... D07B 3/005 57/293
9,404,725 B2 * 8/2016 Ashkenazi ..... G01N 21/00
9,470,657 B2 * 10/2016 Ouellette ..... G01B 7/046
9,896,800 B2 * 2/2018 Melot ..... F16L 1/123
10,113,253 B2 * 10/2018 Hottes ..... B65H 54/28
10,113,267 B2 * 10/2018 Riggs ..... D07B 7/165
10,513,808 B2 * 12/2019 Chen ..... D07B 5/005
2007/0095042 A1 * 5/2007 Bieszczad ..... B65H 81/08 57/3

FOREIGN PATENT DOCUMENTS

DE 10048793 A1 * 4/2002 ..... D01H 4/44
JP S59130638 A 7/1984
JP 2017033815 A 2/2017

* cited by examiner

WIRE STRANDING APPARATUS AND METHOD FOR MANUFACTURING STRANDED WIRE

TECHNICAL FIELD

The present invention relates to a wire stranding apparatus and a method for manufacturing a stranded wire.

BACKGROUND ART

JP2017-33815A discloses a wire stranding apparatus for spirally winding wires unwound and fed from spools around a core wire by revolving the spools having the wires wound and stored thereon around the core wire moving in an axial direction and turning (rotating) the spools.

In this wire stranding apparatus, the wire unwound and fed from the spool extends along the core wire from the spool, has then a predetermined tension applied thereto by a tension device and is, thereafter, spirally wound around the core wire.

SUMMARY OF INVENTION

On the other hand, in such a conventional wire stranding apparatus, it is necessary to increase a revolving speed of the spools together with a moving speed of the core wire in order to increase a manufacturing speed of an obtained stranded wire.

However, if the speed of the spools revolving about the core wire is increased, an inconvenience is that a centrifugal force acts on the wires fed from the spool and extending along the core wire and tensions exceeding the predetermined tension applied by the tension device are applied to the wires by the centrifugal force.

Further, since the wire is pulled out in a circumferential direction of the spool, a diameter of the wire stored on the spool becomes smaller as the wire is pulled out. Then, a distance between the wire pulled out in the circumferential direction of the spool and the core wire also varies, and the centrifugal force acting on the wire fed from the spool and extending along the core wire also changes on every revolution or every time the wire is fed.

If the revolving speed of the spools about the core wire is increased to increase the manufacturing speed of the stranded wire, a situation occurs in which the tensions of the wires to be wound on the core wire constantly change. If the tensions of the wires change, lengths of the wires to be spirally wound on the core wire per unit length also change and it becomes difficult to obtain a stranded wire having a uniform degree of stranding.

The present invention aims to provide a wire stranding apparatus and a method for manufacturing a stranded wire which can increase a manufacturing speed of a stranded wire while making a degree of stranding uniform.

According to one aspect of the present invention, a wire stranding apparatus is provided which includes a core wire moving mechanism configured to move a core wire in an axial direction, a spool configured to feed a wound wire by rotation, a revolving mechanism configured to revolve the spool about the core wire, a rotation driving mechanism configured to feed the wire by rotating the spool, the wire fed from the spool being spirally wound on an outer periphery of the core wire moving in the axial direction by revolution of the spool, and a control device including a wire speed obtaining unit configured to obtain a speed of the wire to be wound on the core wire and a rotation driving mechanism control unit configured to control the rotation driving mechanism such that the speed of the wire obtained by the wire speed obtaining unit has a predetermined value.

According to another aspect of the present invention, a method for manufacturing a stranded wire is provided which includes a winding step of spirally winding a wire fed by rotation of a spool around a core wire by revolving the spool having the wire wound thereon about the core wire moving in an axial direction, wherein the winding step includes obtaining a speed of the wire to be wound on the core wire, and controlling the rotation of the spool such that the obtained speed of the wire has a predetermined value.

DESCRIPTION OF EMBODIMENT

Hereinafter, an embodiment is described with reference to the drawings.

Figure 1:
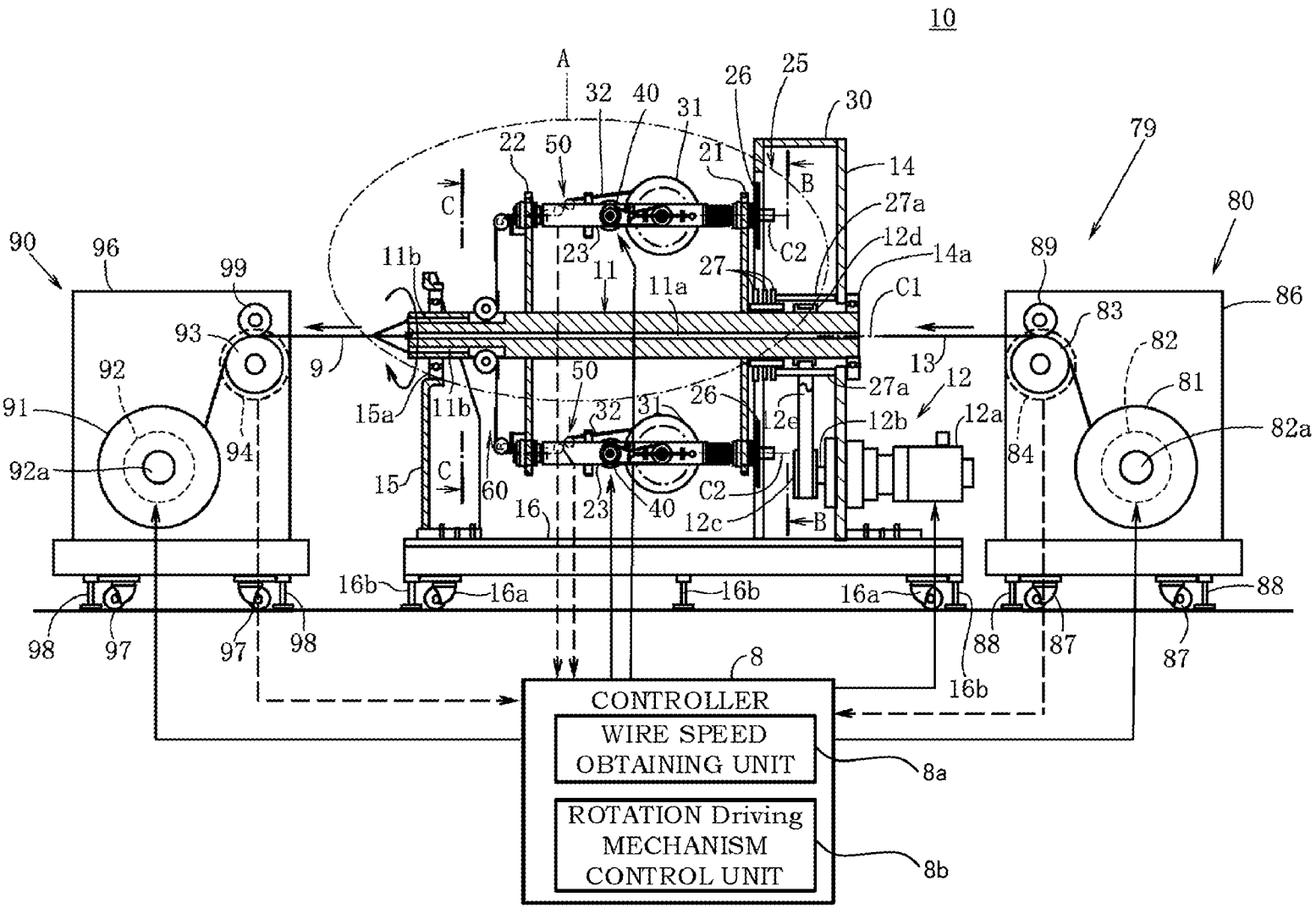
FIG. 1 is a side view partly in section of a wire stranding apparatus according to an embodiment of the present invention.

A wire stranding apparatus 10 according to the present embodiment is shown in FIG. 1. The wire stranding apparatus 10 is controlled by a controller 8 serving as a control device to be described later and includes a revolving mechanism 12 configured to revolve spools 31 about a core wire 13 extending straight. In the present embodiment, the core wire 13 is provided through a center of a shaft member 11, and the revolving mechanism 12 includes the shaft member 11.

The shaft member 11 is a rod-like member having a circular cross-section, and a core wire passage 11*a* through which the core wire 13 passes is formed along a center axis of the shaft member 11. Specifically, the shaft member 11 is a tubular member (specifically, hollow cylindrical member) provided to linearly extend, and the core wire passage 11*a* through which the core wire 13 passes is formed on an inner peripheral side of the shaft member 11. A plurality of nozzles 11*b* through which wires 32 unwound and fed from the spools 31 are inserted are provided radially at equal angles about the core wire passage 11*a* on the tip of the shaft member 11 (see FIG. 5).

Figure 5:
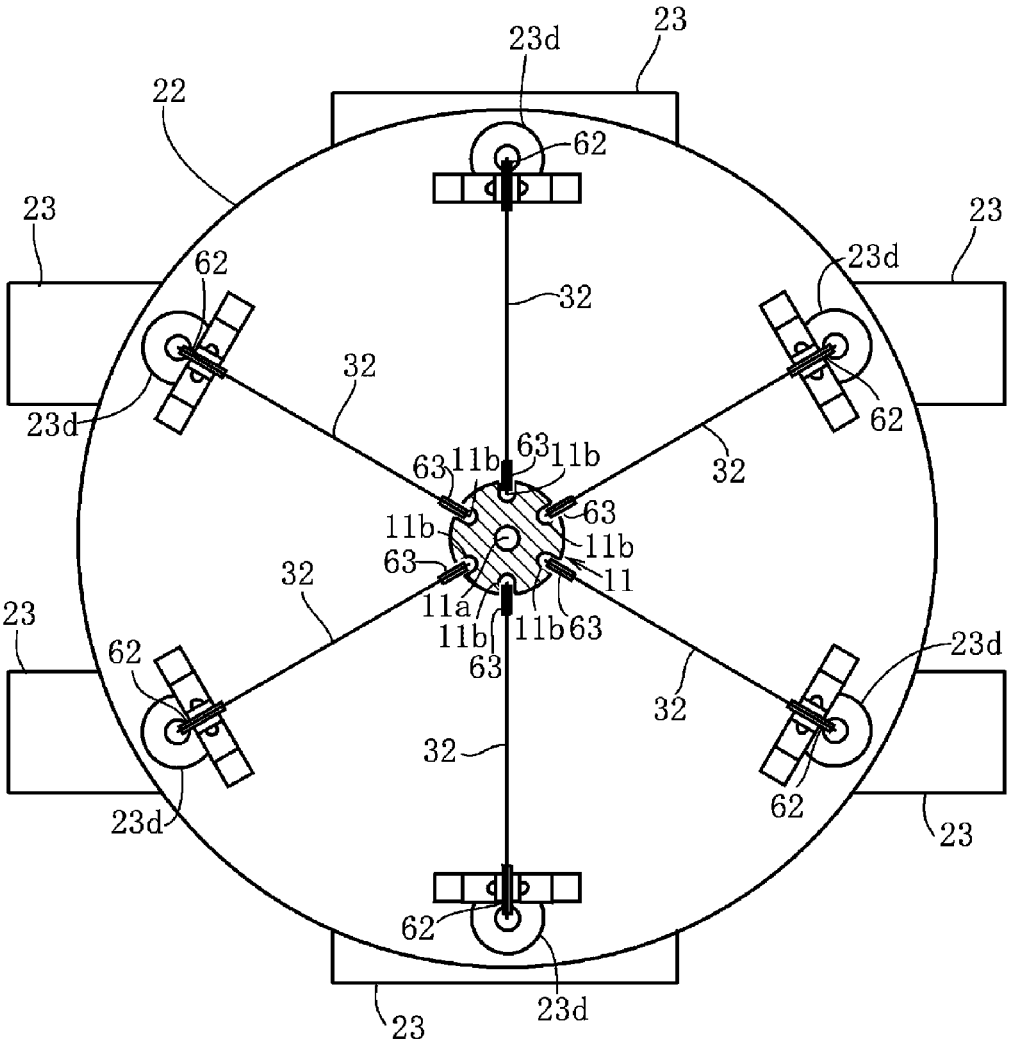
FIG. 5 is a sectional view along line C-C of FIG. 1.

The nozzles 11*b* are holes formed parallel to the core wire passage 11*a* in the tip of the shaft member 11 and, as shown in FIG. 5, six nozzles 11*b* composed of the holes are formed at every 60° about the core wire passage 11*a*.

Referring back to FIG. 1, a base end side end edge and a tip side end edge of the shaft member 11 are respectively rotatably supported on base plates 14, 15 via bearings 14*a*, 15*a*. The base plates 14, 15 stand on a base 16 such that the shaft member 11 is horizontal. A plurality of rollers 16*a* capable of moving the base 16 and a plurality of supporting legs 16*b* on which the base 16 can be placed are provided on the base 16.

A servo motor 12*a* constituting the revolving mechanism 12 is so provided on the base end side base plate 14 that a rotary shaft 12*b* thereof is parallel to the shaft member 11. A first pulley 12*c* is provided on the rotary shaft 12*b* of the revolving mechanism 12. A second pulley 12*d* is provided on a base end side of the shaft member 11 corresponding to the first pulley 12*c*, and a belt 12*e* is stretched between the first and second pulleys 12*c*, 12*d*.

A control output of the controller 8 is connected to the servo motor 12*a*. If the servo motor 12*a* is driven in response to a command from the controller 8 to rotate the rotary shaft 12*b* together with the first pulley 12*c*, that rotation is transmitted to the second pulley 12*d* via the belt 12*e* and the shaft member 11 having the second pulley 12*d* provided thereon rotates about the core wire passage 11*a*.

The shaft member 11 is provided with a pair of supporting plates 21, 22 at a predetermined distance from each other in the axial direction. A plurality of revolving bodies 23 are rotatably supported on the pair of supporting plates 21, 22. The revolving bodies 23 are configured to support the spools 31. The plurality of revolving bodies 23 are so rotatably supported on the pair of supporting plates 21, 22 that axes of rotation C2 thereof are parallel to a center axis C1 of the shaft member 11. In the present embodiment, six revolving bodies 23 as many as the nozzles 11*b* are provided (see FIGS. 4 and 5).

Figure 3:
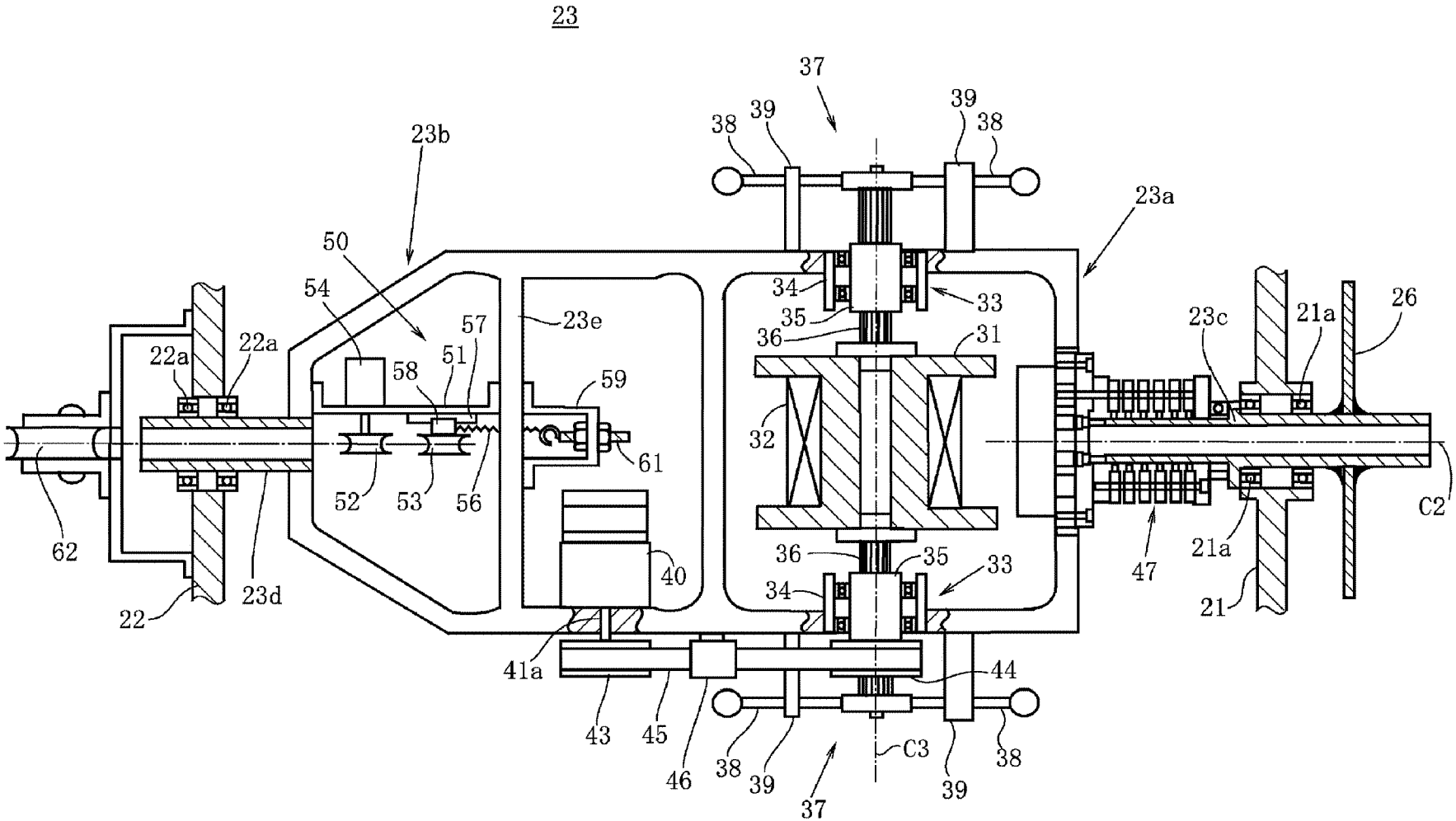
FIG. 3 is a plan view partly in section of a revolving body.

Since each of the plurality of revolving bodies 23 has the same structure, one of these is described. As shown in FIG. 3, the revolving body 23 is composed of a rectangular part 23*a* located on the base end side of the shaft member 11 and a trapezoidal part 23*b* located on the tip end side of the shaft member 11. Hollow cylindrical pivoting members 23*c*, 23*d* are respectively provided on both ends of these parts on the axis of rotation C2. The pivoting members 23*c*, 23*d* are respectively rotatably supported on the pair of supporting plates 21, 22 via bearings 21*a*, 22*a*. As just described, the plurality of revolving bodies 23 are so rotatably supported on the supporting plates 21, 22 that the axis of rotation C2 is parallel to the center axis C1 of the shaft member 11, and revolve about the center axis C1 by the rotation of the shaft member 11.

Figure 4:
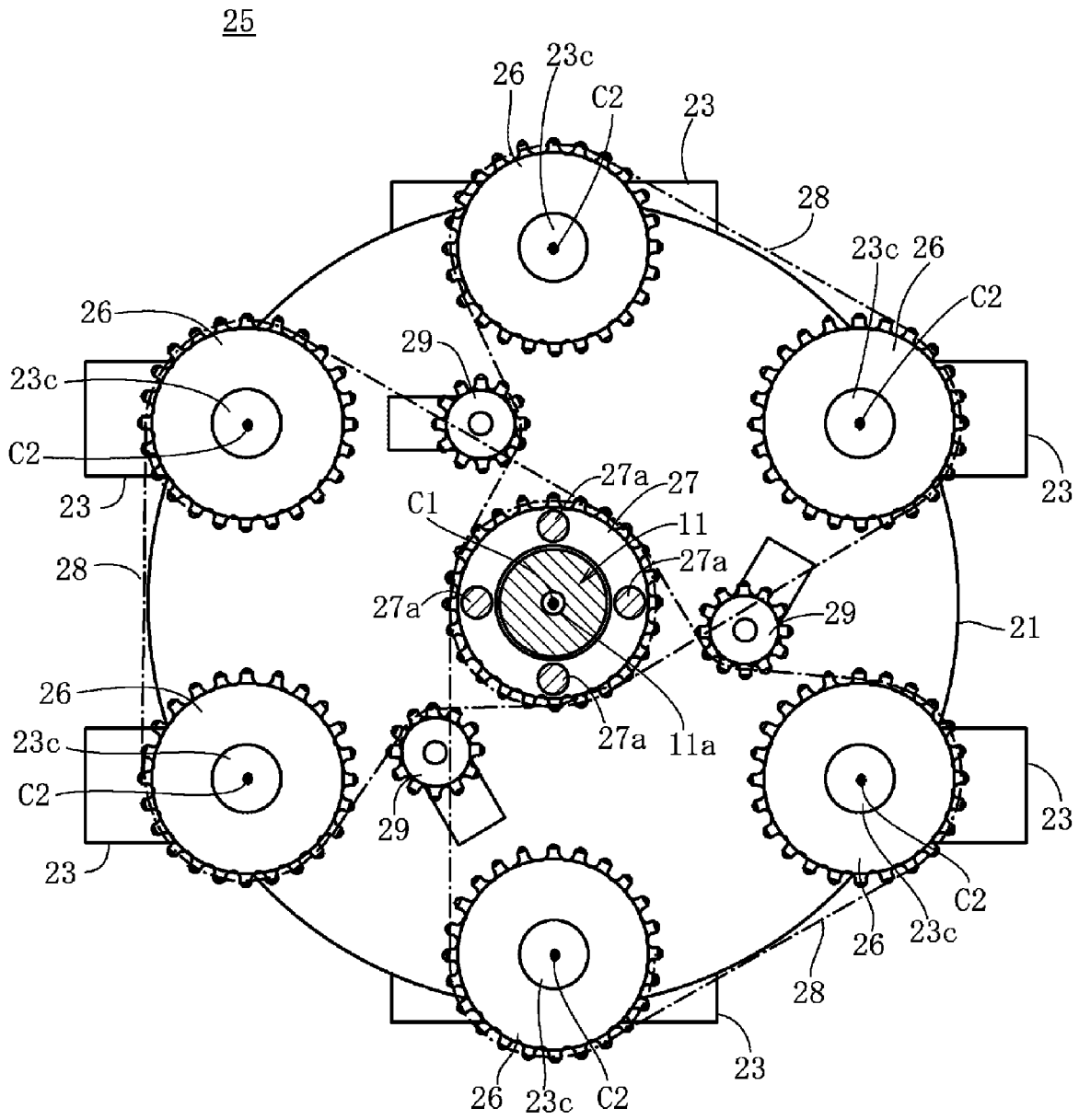
FIG. 4 is a sectional view along line B-B of FIG. 1.

Referring back to FIG. 1, the wire stranding apparatus 10 is provided with a rotation prohibiting mechanism 25 for prohibiting the rotation of the revolving bodies 23. As shown in FIG. 4, the rotation prohibiting mechanism 25 includes first sprockets 26 provided coaxially with the axes of rotation C2 of the revolving bodies 23 on the pivoting members 23*c* on the base end sides of the revolving bodies 23, a second sprocket 27 having the same size and shape as the first sprockets 26 and non-rotatably mounted on the base end side base plate 14 (FIG. 1) to be coaxial with the shaft member 11, and chains 28 coupling the first sprockets 26 and the second sprocket 27. It should be noted that parts denoted by reference sign 27*a* are mounting legs 27*a* for mounting the second sprocket 27 on the base end side base plate 14 (FIG. 1).

As just described, even if the shaft member 11 rotates, the second sprocket 27 does not rotate. Accordingly, the first sprockets 26 themselves coupled to the second sprocket 27 via the chains 28 do not rotate even if the first sprockets 26 revolve about the center axis C1 of the shaft member 11. Thus, the revolving bodies 23 having the first sprockets 26 provided on the pivoting members 23*c* are prohibited from rotating.

Thus, as shown in FIGS. 1 to 4, when the revolving bodies 23 extend between the pair of supporting plates 21, 22 while being held in a horizontal state (reference state) parallel to the base 16, the plurality of revolving bodies 23 revolve around the shaft member 11 if the supporting plates 21, 22 rotate together with the shaft member 11, but the revolving bodies 23 themselves are prohibited from rotating. Therefore, the plurality of revolving bodies 23 revolve around the shaft member 11 in the horizontal state.

As shown in FIG. 4, six revolving bodies 23 are provided at every 60° on the supporting plate 21. Thus, the single chain 28 is routed around the first sprockets 26 of a pair of the revolving bodies 23 adjacent in the circumferential direction, and this chain 28 is further routed around the single second sprocket 27 provided coaxially with the center axis C1 of the shaft member 11. In this way, the six revolving bodies 23 are prohibited from rotating by three chains 28. Further, auxiliary sprockets 29 configured to apply a tension are respectively provided to tighten each chain 28.

Further, as shown in FIG. 1, a covering member 30 configured to cover the rotation prohibiting mechanism 25 and the pulleys 12*c*, 12*d*, the belt 12*e* and the like constituting the revolving mechanism 12 is provided on the base plate 14 rotatably supporting the base end of the shaft member 11.

Figure 2:
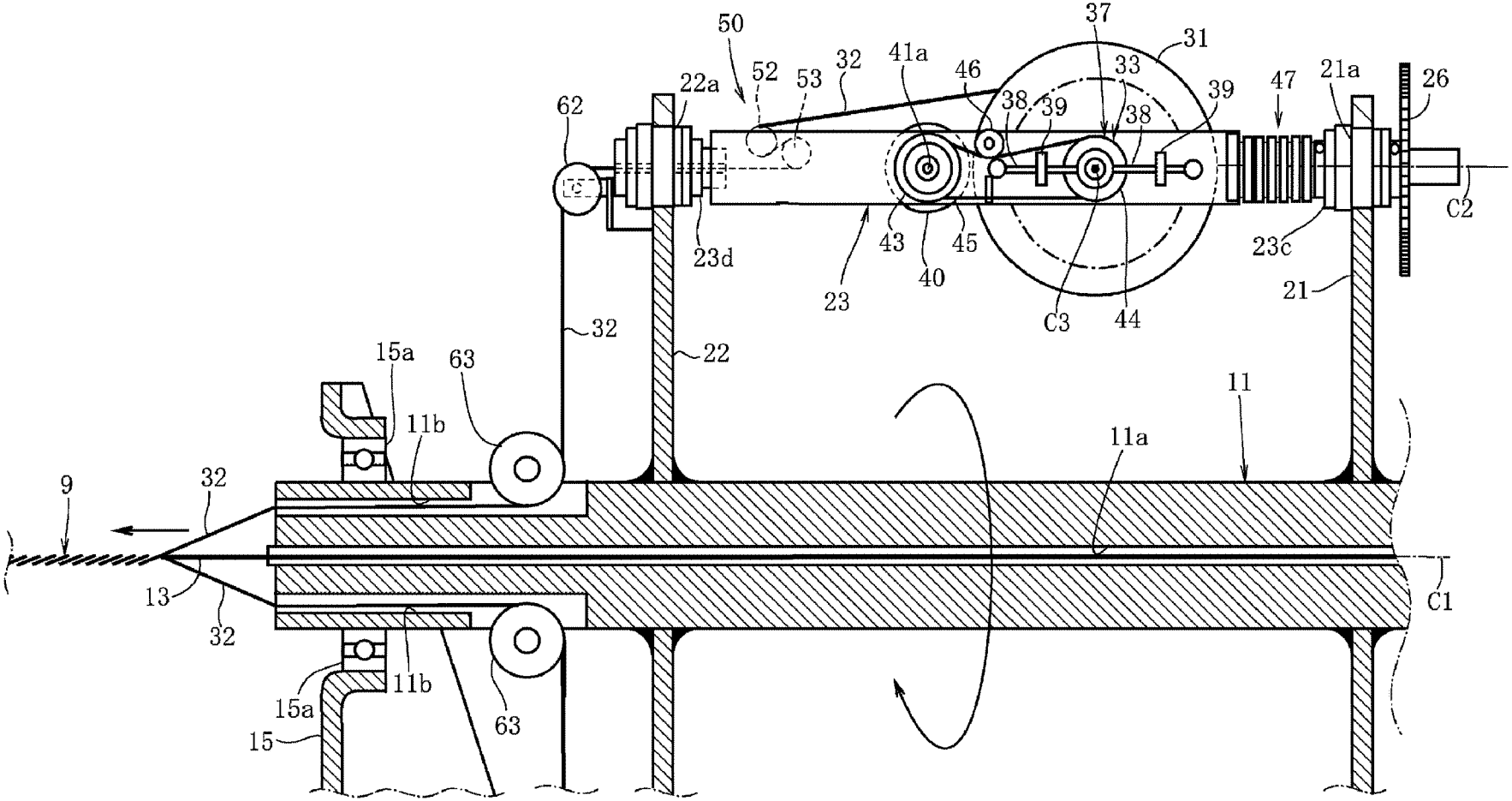
FIG. 2 is an enlarged view of a part A of FIG. 1.

As shown in FIGS. 1 to 3, the spools 31 having the wires 32 wound thereon are respectively mounted on the plurality of revolving bodies 23. Since each of the spools 31 has the same mounting structure, one of these is described. As shown in FIG. 3, the spool 31 is so rotatably supported on the revolving body 23 that a center axis C3 of the spool 31 is perpendicular to the center axis C1 of the shaft member 11 and the axis of rotation C2 of the revolving body 23 parallel to the center axis C1 to unwound the wire 32 by the rotation of the spool 31. Thus, the spool 31 is configured revolvably around the shaft member 11 via the revolving body 23.

A pair of supporting members 33, 33 configured to support both sides of the spool 31 are provided in the rectangular part 23*a* of the revolving body 23. Since the pair of supporting members 33, 33 have the same structure, one of these is described. The supporting member 33 includes a hollow cylindrical mounting member 34 mounted on the revolving body 23, a hollow cylindrical rotating body 35 supported on the inner peripheral surface of the mounting member 34 via a bearing and a locking rod 36 spline-coupled to the rotating body 35 and provided movably in an axial direction. The mounting member 34 is so provided in the rectangular part 23*a* of the revolving body 23 that a center axis of the locking rod 36 is perpendicular to the center axis C1 of the shaft member 11. The locking rods 36, 36 of the pair of supporting members 33, 33 are mounted movably toward and away from the spool 31.

Since the pair of locking rods 36 are provided on the same axis, the spool 31 is so supported that the center axis C3 of the spool 31 is perpendicular to the center axis C1 of the shaft member 11 and the axis of rotation C2 of the rotating body 23 parallel to the center axis C1 by facing end parts of the pair of locking rods 36 approaching each other and sandwiching the spool 31 from both sides. That is, the center axis C3 of the spool 31 is coaxial with center axis of the locking rods 36. Further, the other end parts of the pair of locking rods 36 are provided to project from both sides of the rectangular part 23*a*. The rectangular part 23*a* is provided with locking tools 37 for preventing the locking rods 36 from being separated from each other.

As shown in FIGS. 2 and 3, the locking tool 37 includes handle bars 38 rotatably mounted on an end edge of the locking rod 36 to be perpendicular to the locking rod 36 and locking hooks 39 for locking the handle bars 38 to the revolving body 23 with the spool 31 supported by the locking rod 36. By releasing the locking of the handle bars 38 by the locking hooks 39, the pair of locking rods 36 can be moved away from each other. If the pair of locking rods 36 are moved away from each other, the spool 31 sandwiched therebetween can be removed.

Further, the wire stranding apparatus 10 includes a rotation driving mechanism 40 configured to unwind and feed the wire 32 by being controlled by the controller 8 and rotating the spool 31. The rotation driving mechanism 40 is a servo motor 40 provided in parallel to the spool 31 and, as shown in FIG. 3, the servo motor 40 is provided on the rectangular part 23*a* of the revolving body 23.

The servo motor 40 is so mounted on the rectangular part 23*a* that a rotary shaft 41*a* is parallel to the locking rods 36. Further, the servo motor 40 is so mounted on the rectangular part 23*a* that one end of the rotary shaft 41*a* projects outwardly of the rectangular part 23*a*. A third pulley 43 is mounted on the rotary shaft 41*a* projecting outwardly of the rectangular part 23*a*. A fourth pulley 44 is provided on the rotating body 35 in the supporting member 33 corresponding to the third pulley 43, and a belt 45 is stretched between the third and fourth pulleys 43, 44.

Each control output of the controller 8 (FIG. 1) serving as the control device is connected to the servo motor 40. If the servo motor 40 rotates the rotary shaft 41*a* together with the third pulley 43 in response to a command from the controller 8, that rotation is transmitted to the fourth pulley 44 via the belt 45. Then, the rotating body 35 having the fourth pulley 44 provided thereon rotates together with the locking rod 36 spline-coupled to the rotating body 35 and unwinds and feeds the wire 32 by rotating the spool 31 if the locking rods 36 are sandwiching the spool 31.

It should be noted that a member denoted by reference sign 46 in FIGS. 2 and 3 is an auxiliary pulley 46 configured to prevent the slack of the belt 45, and a member denoted by reference sign 47 is a connector 47 for electrically connecting the servo motor 40 and the like provided on the revolving body 23 configured to revolve around the shaft member 11 to the controller 8 serving as the control device provided outside the revolving body 23, an unillustrated power supply and the like.

As shown in FIGS. 2 and 3, a supporting plate 51 parallel to the pivoting member 23*d* is provided in the trapezoidal part 23*b* of the revolving body 23. Specifically, the trapezoidal part 23*b* is provided with the supporting plate 51 extending in the same direction as an extending direction of the pivoting member 23*d*. The supporting plate 51 is provided with a wire speed obtaining auxiliary mechanism 50. The wire speed obtaining auxiliary mechanism 50 is provided with a plurality of pulleys 52, 53 for guiding the wire 32 fed from the spool 31 to pass the wire 32 through the pivoting member 23*d* rotatably supported on the tip side supporting plate 22 of the shaft member 11.

As shown in FIG. 2, the tip side supporting plate 22 is provided with a first turning pulley 62 for turning the wire 32 passed through the pivoting member 23*d* toward the shaft member 11. A second turning pulley 63 for further turning the wire 32 moving toward the shaft member 11 from the first turning pulley 62, allowing the wire 32 to pass through the nozzle 11*b* and causing the wire 32 to project from the tip side of the shaft member 11 is provided for each nozzle 11*b* at a location of the shaft member 11 where the tip side supporting plate 22 is provided.

Accordingly, the wire 32 unwound from the spool 31 and passed through the pivoting member 23*d* rotatably supported on the tip side supporting plate 22 is, thereafter, guided to the nozzle 11*b* (FIG. 1) provided on the tip of the shaft member 11.

When the shaft member 11 is rotated by the revolving mechanism 12 (FIG. 1), the plurality of nozzles 11*b* rotate around the core wire passage 11*a* together with the shaft member 11. Thus, the core wire 13 is moved in the axial direction in the core wire passage 11*a* and the shaft member 11 is rotated about the center axis C1 of the core wire passage 11*a*. When the wires 32 are fed from the plurality of nozzles 11*b*, the plurality of fed wires 32 are spirally wound around the core wire 13 fed from the tip of the shaft member 11, whereby a stranded wire 9 composed of the core wire 13 and the plurality of wires 32 spirally wound around the core wire 13 is obtained.

Thus, as shown in FIG. 1, the wire stranding apparatus 10 includes a core wire moving mechanism 79 configured to move the core wire 13 in the axial direction (i.e. axial direction of the shaft member 11). The core wire moving mechanism 79 includes a core wire supply machine 80 configured to supply the core wire 13 to the core wire passage 11*a* from the base end side of the shaft member 11 and a collecting device 90 configured to collect the obtained stranded wire 9.

The collecting device 90 is configured to wind the stranded wire 9 on a drum 91 at a constant speed and includes the drum 91 configured to wind the stranded wire 9, a winding motor 92 configured to rotate the drum 91, a collection-side speed detection pulley 93 around which the stranded wire 9 to be wound on the drum 91 is routed, and a collection-side rotation sensor 94 constituted, for example, by an encoder configured to detect a rotating speed of the collection-side speed detection pulley 93.

The motor 92 is so mounted on a basal plate 96 that a rotary shaft 92*a* thereof is perpendicular to the center axis C1 of the shaft member 11. The drum 91 is coaxially mounted on the rotary shaft 92*a* of the motor 92. Further, the collection-side speed detection pulley 93 is so mounted on the basal plate 96 that the stranded wire 9 routed therearound is located on an extension of the core wire passage 11*a*. A plurality of rollers 97 capable of moving the collecting device 90 and supporting legs 98 on which the collecting device 90 can be placed are provided on the basal plate 96. The stranded wire 9 is wound on the drum 91 after being routed around the collection-side speed detection pulley 93. Here, a member denoted by reference sign 99 in FIG. 1 is a nipping roller 99 configured to nip the stranded wire 9 together with the collection-side speed detection pulley 93 so that the stranded wire 9 routed around the collection-side speed detection pulley 93 is not disengaged from the collection-side speed detection pulley 93.

A detection output of the collection-side rotation sensor 94 is input to the controller 8. Further, the controller 8 is connected to the winding motor 92. Here, a winding speed of the stranded wire 9 on the drum 91 is determined by the rotating speed of the collection-side speed detection pulley 93 around which the stranded wire 9 is routed. Thus, in order for the stranded wire 9 to be wound on the drum at a constant speed, the controller 8 controls the winding motor 92 such that the rotating speed of the collection-side speed detection pulley 93 output by the collection-side rotation sensor 94 is constant.

On the other hand, the core wire supply machine 80 includes a feeding spool 81 on which the core wire 13 is wound and stored, a feeding motor 82 configured to rotate the feeding spool 81, a supply-side speed detection pulley 83 around which the core wire 13 unwound from the feeding spool 81 is routed, and a supply-side rotation sensor 84 constituted, for example, by an encoder configured to detect a rotating speed of the supply-side speed detection pulley 83.

The motor 82 is so mounted on a basal plate 86 that a rotary shaft 82*a* thereof is perpendicular to the center axis C1 of the shaft member 11. The feeding spool 81 is coaxially mounted on the rotary shaft 82*a* of the motor 82. Further, the supply-side speed detection pulley 83 is mounted on the basal plate 86 to be located on an extension of the core wire passage 11*a* so that the routed and fed core wire 13 extends straight to the core wire passage 11*a* and is directly supplied. A plurality of rollers 87 capable of moving the core wire supply machine 80 and supporting legs 88 on which the core wire supply machine 80 can be placed are provided on the basal plate 86. The core wire 13 unwound and fed by the rotation of the feeding spool 81 is inserted into the core wire passage 11*a* after being routed around the supply-side speed detection pulley 83.

A detection output of the supply-side rotation sensor 84 is input to the controller 8. Further, the controller 8 is connected to the feeding motor 82. Here, a member denoted by reference sign 89 in FIG. 1 is a nipping roller 89 configured to nip the core wire 13 together with the supply-side speed detection pulley 83 so that the core wire 13 routed around the supply-side speed detection pulley 83 is not disengaged from the supply-side speed detection pulley 83.

The core wire 13 to be inserted into the core wire passage 11*a* is fed by the rotation of the feeding spool 81 by the feeding motor 82. A feeding speed is detected on the basis of the rotating speed of the supply-side speed detection pulley 83. Specifically, the feeding speed of the core wire 13 is determined by the rotating speed of the supply-side speed detection pulley 83. In order to unwind the core wire 13 at a constant speed from the feeding spool 81 and supply the core wire 13 to the core wire passage 11*a*, the controller 8 controls the feeding motor 82 such that the rotating speed of the supply-side speed detection pulley 83 output by the supply-side rotation sensor 84 is constant.

Further, the controller 8 obtains each of the winding speed of the stranded wire 9 determined by the rotating speed of the collection-side speed detection pulley 93 and the feeding speed of the core wire 13 determined by the rotating speed of the supply-side speed detection pulley 83 and controls each of the winding motor 92 and the feeding motor 82 such that the feeding speed of the core wire 13 and the winding speed of the stranded wire 9 reach a target value.

In this way, the feeding speed of the core wire 13 and the winding speed of the stranded wire 9 can be kept at the target value even if an outer diameter of the core wire 13 wound on the feeding spool 81 and an outer diameter of the stranded wire 9 wound on the drum 91 change due to the feeding of the core wire 13 and the winding of the stranded wire 9.

Further, although the wire stranding apparatus 10 is provided with the wire speed obtaining auxiliary mechanisms 50 used to obtain a winding speed of the wire 32 to be wound on the core wire 13, there is no limitation to this. For example, a wire speed detection sensor may be provided which detects the winding speed of the wire 32. As shown in FIGS. 2 and 3, the wire speed obtaining auxiliary mechanism 50 includes a speed detection pulley 52 provided on the trapezoidal part 23*b* in the revolving body 23 via the supporting plate 51 and, for example, a rotary encoder 54 (FIG. 3) provided on the supporting plate 51 to detect a rotating speed of the speed detection pulley 52.

In FIG. 2, the wire 32 unwound and supplied from the spool 31 is further routed around an auxiliary pulley 53 after being routed around the speed detection pulley 52, so that the wire 32 routed around the auxiliary pulley 53 passes through the pivoting member 23*d*. As shown in FIG. 3, the revolving body 23 is provided with an elastic body 56 configured to bias the auxiliary pulley 53 to move the auxiliary pulley 53 in a direction to extend the wire 32 between the speed detection pulley 52 and the pivoting member 23*d*.

Specifically, a rail 57 parallel to the pivoting member 23*d* is provided on the supporting plate 51 in the revolving body 23. That is, the rail 57 extending in the same direction as the extending direction of the pivoting member 23*d* is provided on the supporting plate 51. A pivot table 58 is provided on the rail 57 reciprocally movably along the rail 57. A gate-shaped member 59 is provided on a boundary member 23*e* between the rectangular part 23*a* and the trapezoidal part 23*b* of the revolving body 23 to bulge toward the rectangular part 23*a* on an extension of the rail 57. A screw member 61 penetrating through a projecting end of the gate-shaped member 59 is so mounted in the gate-shaped member 59 that a movement thereof is adjustable in an axial direction (longitudinal direction). A coil spring 56 serving as an elastic body is provided in an extended state between the screw member 61 and the pivot table 58. It should be noted that the coil spring 56 is configured to penetrate through the boundary member 23*e*.

The auxiliary pulley 53 is rotatably supported on the pivot table 58. If the coil spring 56 pulls the auxiliary pulley 53 toward the rectangular part 23*a* together with the pivot table 58, the wire 32 unwound from the spool 31 and to be wound on the core wire 13 is stretched between the speed detection pulley 52 and the pivoting member 23*d*, thereby preventing a situation in which the wire 32 is slackened and disengaged from the speed detection pulley 52. By changing an extended length of the coil spring 56 serving as the elastic body by moving and adjusting the screw member 61 in the longitudinal direction, a biasing force for stretching the wire 32 can be made variable.

As shown in FIG. 1, a detection output of the rotary encoder 54 (FIG. 3) in the wire speed obtaining auxiliary mechanism 50 is input to the controller 8. Further, the controller 8 is connected to the servo motor 40 serving as the rotation driving mechanism configured to unwind the wire 32 by rotating the spool 31. Here, the speed of the wire 32 to be wound on the core wire 13 is determined by the rotating speed of the speed detection pulley 52 around which the wire 32 is routed. The controller 8 controls the servo motor 40 serving as rotation driving mechanism such that the rotating speed of the speed detection pulley 52 output by the rotary encoder 54 has a predetermined value.

The controller 8 includes a wire speed obtaining unit 8*a* configured to calculate and obtain a speed of the wire 32 to be wound on the core wire 13 on the basis of the rotating speed of the speed detection pulley 52 output by the rotary encoder 54 and a rotation driving mechanism control unit 8*b* configured to control the servo motor 40 serving as the rotation driving mechanism such that the speed of the wire 32 obtained by the wire speed obtaining unit 8*a* has a predetermined value.

The controller 8 is constituted by a microcomputer including a central processing unit (CPU), a read only memory (ROM), a random access memory (RAM) and an input/output interface (I/O interface). The controller 8 can also be constituted by a plurality of microcomputers. It should be noted that the wire speed obtaining unit 8*a* and the rotation driving mechanism control unit 8*b* are virtual units representing functions of the controller 8 and do not mean the physical existence.

Although the wire speed obtaining unit 8*a* calculates and obtains the speed of the wire 32 to be wound on the core wire 13 on the basis of the rotating speed of the speed detection pulley 52 output by the rotary encoder 54 in the present embodiment, there is no limitation to this. For example, a wire speed detection sensor may directly obtain the speed of the wire to be detected without calculating.

A method for manufacturing the stranded wire 9 according to the present embodiment is described below.

The method for manufacturing the stranded wire 9 includes a winding step of spirally winding the wires 32 unwound and fed by the rotation of the spools 31 around the core wire 13 by revolving the spools 31 having the wires 32 wound and stored thereon about the core wire 13 moving in the axial direction.

In the winding step, the winding speed of the wires 32 to be wound on the core wire 13 is obtained, and the wires 32 unwound and fed from the spools 31 are spirally wound around the core wire 13 fed from the tip of the shaft member 11 by revolving the spools 31 around the core wire 13 while controlling the rotation of the spools 31 such that the winding speed of the wires 32 to be wound on the core wire 13 has a predetermined value.

In the method for manufacturing the stranded wire 9 using the above wire stranding apparatus 10, the stranded wire 9 is manufactured by supplying the core wire 13 to the core wire passage 11*a* from the base end side of the shaft member 11 while revolving the revolving bodies 23 and spirally winding the wires 32 around the core wire 13 fed from the tip end of the shaft member 11 since the core wire passage 11*a* through which the core wire 13 passes is formed on the inner peripheral side of the shaft member 11.

A specific procedure of the method is as follows.

First, the feeding spool 81 having the core wire 13 wound and stored thereon is prepared, and the feeding spool 81 is so mounted on the rotary shaft 82*a* of the feeding motor 82 that the rotary shaft of the feeding spool 81 is perpendicular to the center axis C1 of the shaft member 11 as shown in FIG. 1. Then, the core wire 13 unwound from the feeding spool 81 is inserted into the core wire passage 11*a* after being routed around the supply-side speed detection pulley 83.

On the other hand, a plurality of the spools 31 having the wires 32 wound and stored thereon are prepared and mounted on the plurality of revolving bodies 23 as shown in FIG. 3. Specifically, the spool 31 is located between the pair of locking rods 36 separated from each other and, thereafter, the pair of locking rods 36 are brought closer to each other to sandwich the spool 31 from both sides. As a result, the spool 31 is so rotatably supported on the revolving body 23 that the center axis C3 of the spool 31 is perpendicular to the center axis C1 of the shaft member 11. Then, the locking rods 36 are locked to the locking tools 37 to prevent the locking rods 36 from being separated from each other.

Subsequently, as shown in FIG. 2, the wires 32 unwound form the spools 31 are routed around the plurality of pulleys 52, 53 constituting the wire speed obtaining auxiliary mechanisms 50 and passed through the pivoting members 23*d* rotatably supported on the tip side supporting plates 22 of the shaft member 11. Then, the wires 32 passed through the pivoting members 23*d* are passed through the nozzles 11*b* on the tip of the shaft member 11.

In this way, the plurality of wires 32 successively pulled out from the plurality of nozzles 11*b* are routed around the collection-side speed detection pulley 93 constituting the collecting device 90 together with the core wire 13 pulled out from the tip of the shaft member 11 as shown in FIG. 1 and, thereafter, end parts thereof are locked to the drum 91.

From this state, in order for the core wire 13 to move at a constant speed in the axial direction in the core wire passage 11*a* of the shaft member 11, each of the winding motor 92 and the feeding motor 82 is so controlled that the winding speed of the stranded wire 9 wound by the drum 91 and the feeding speed of the core wire 13 in the core wire supply machine 80 have a target value.

In this way, the stranded wire 9 is manufactured by moving the core wire 13 in the axial direction, rotating the shaft member 11 to revolve the plurality of spools 31 about the shaft member 11, and spirally winding the plurality of wires 32 respectively unwound from the plurality of spools 31 and successively fed from the plurality of nozzles 11*b* on the tip of the shaft member 11 around the core wire 13 successively fed from the tip of the shaft member 11.

In moving the core wire 13, the controller 8 controls each of the winding motor 92 and the feeding motor 82 such that the feeding speed of the core wire 13 and the winding speed of the stranded wire 9 have the target value. Further, to make a winding pitch of the wire 32 spirally wound around the core wire 13 uniform, the controller 8 controls the rotating speed of the shaft member 11 such that the spools 31 revolve at a predetermined speed determined by the moving speed of the core wire 13. Then, the manufactured stranded wire 9 is successively wound and collected on the drum 91.

As just described, the controller 8 controls each of the winding motor 92 and the feeding motor 82 such that the feeding speed of the core wire 13 and the winding speed of the stranded wire 9 have the target value, whereby the moving speed of the core wire 13 moving in the axial direction in the core wire passage 11*a* of the shaft member 11 can be kept at a constant target value even if the outer diameter of the core wire 13 wound on the feeding spool 81 and the outer diameter of the stranded wire 9 wound on the drum 91 change due to the feeding of the core wire 13 and the winding of the stranded wire 9.

Further, the rotation of the plurality of revolving bodies 23 configured to revolve around the shaft member 11 is prohibited by the rotation prohibiting mechanism 25. Then, the spools 31 rotatably supported on the revolving bodies 23 are rotated by the rotation driving mechanism 40 to unwind the wires 32, and the wires 32 pulled in the circumferential directions of the spools 31 are not twisted when being pulled out. The stranded wire 9 obtained by winding the untwisted wires 32 around the core wire 13 in this way is not untwisted due to the twist of wires 32.

Thus, the stranded wire 9 in which the wires 32 are spirally regularly stranded at a predetermined pitch around the core wire 13 having a unit length can be obtained by revolving the spools 31 around the shaft member 11 at a desired speed corresponding to the moving speed of the core wire 13.

Further, in the present embodiment, the winding speed of the wires 32 to be wound on the core wire 13 is obtained and the rotation of the spools 31 is so controlled that the winding speed of the wires 32 to be wound on the core wire 13 has the predetermined value when the wires 32 are spirally wound around the core wire 13. In the above wire stranding apparatus 10, the winding speed of the wires 32 to be wound on the core wire 13 is obtained by the wire speed obtaining unit 8*a* of the controller 8. Specifically, the wire speed obtaining unit 8*a* of the controller 8 calculates and obtains the winding speed of the wires 32 on the basis of the rotating speeds of the speed detection pulleys 52 around which the wires 32 are routed, the rotating speeds being detected by the rotary encoders 54, and the rotation of the spools 31 is controlled by the servo motors 40 on the basis of a command from the rotation driving mechanism control unit 8*b* of the controller 8.

If the spools 31 are revolved about the core wire 13 when the wires 32 unwound and fed from the spools 31 extend along the core wire 13 moving in the axial direction and are, thereafter, spirally wound around the core wire 13 moving in the axial direction, a centrifugal force acts on the wires 32 fed from the spools 31 and extending along the core wire 13.

If a revolving speed of the spools 31 revolving about the core wire 13 is increased for the purpose of increasing the manufacturing speed of the stranded wire 9 in a state where the centrifugal force is acting on the wires 32 extending along the core wire 13 in this way, tensions are produced in the wires 32 by the centrifugal force acting on the wires 32 to resist the centrifugal force.

Further, since the wire 32 is pulled in the circumferential direction of the spool 31, a winding diameter of the wire 32 stored on the spool 31 decreases as the wire 32 is pulled out. A distance between the wire 32 pulled out in the circumferential direction of the spool 31 and the core wire 13 also varies and the centrifugal force acting on the wire 32 fed from the spool 31 and extending along the core wire 13 also changes on every revolution or every time the wire 32 is fed.

Then, if the revolving speed of the spools 31 is increased together with the feeding speed of the core wire 13, the tensions produced in the wires 32 to resist the centrifugal force also change on every revolution of the spools 31 or every time the wires 32 are fed, and the tensions of the wires 32 wound on the core wire 13 constantly change.

However, in the present embodiment, the speed of the wires 32 to be wound on the core wire 13 is obtained and the rotation of the spools 31 is so controlled that the speed of the wires 32 has the predetermined value. In the controller 8, the wire speed obtaining unit 8*a* obtains the speed of the wires 32 to be wound on the core wire 13 and the rotation driving mechanism control unit 8*b* controls the rotation of the spools 31 feeding the wires 32 such that the speed of the wires 32 to be wound on the core wire 13 has the predetermined value.

Specifically, if tensions applied to the wires 32 increase, for example, because a centrifugal force acts on the wires 32 being fed from the spools 31, the feeding speed of the wires 32 to be wound on the core wire 13 may be slowed down. However, in this case, the slowdown of the feeding speed of the wires 32 to be wound on the core wire 13 can be prevented and the feeding speed can be kept constant by speeding up the rotation of the spools 31.

Conversely, if the centrifugal force acting on the wires 32 decreases, the tensions applied to the wires 32 also decrease and the feeding speed of the wires 32 to be wound on the core wire 13 is speeded up. In this case, the speeding-up of the feeding speed of the wires 32 to be wound on the wire 13 can be prevented and the feeding speed can be kept constant by slowing down the rotation of the spool 31.

Even if the centrifugal force acts on the wires 32 fed from the spools 31 and the tensions applied to the wires 32 change, lengths of the wires 32 to be spirally wound on the core wire 13 per unit length do not change.

Specifically, at the time of a movement of the core wire 13 per unit length, the number of revolutions and angles of the spools 31 do not change. Thus, if the lengths of the wires 32 have such a predetermined value that the speed of the wires 32 to be wound on the core wire 13 is constant, the lengths of the wires 32 fed from each nozzle 11*b* and to be spirally wound on the core wire 13 per unit length are always constant.

Then, in order to increase the manufacturing speed of the stranded wire 9, it is necessary to increase the revolving speed of the spools 31 about the core wire 13 together with the moving speed of the core wire 13. However, in the present embodiment in which the rotation of the spools 31 is so controlled that the speed of the wires 32 to be wound on the core wire 13 has the predetermined value, even if the moving speed of the core wire 13 and the revolving speed of the spools 31 about the core wire 13 are increased, the lengths of the wires 32 to be spirally wound on the core wire 13 per unit length are always constant. Thus, it is possible to obtain the stranded wire 9 having a uniform degree of stranding.

Therefore, in the wire stranding apparatus 10 and the method for manufacturing the stranded wire 9 of the present embodiment, the manufacturing speed of the stranded wire 9 can be remarkably increased while the degree of stranding is made uniform.

According to the above embodiment, the following effects are achieved.

In the wire stranding apparatus 10 and the method for manufacturing the stranded wire 9 of the present embodiment, the controller 8 controls the rotation of the spools 31 feeding the wires 32 such that the speed of the wires 32 to be wound on the core wire 13 has the predetermined value. Thus, even if a centrifugal force acts on the wires 32 fed from the spools 31 and tensions applied to the wires 32 change, the lengths of the wires 32 to be spirally wound on the core wire 13 per unit length do not change. Therefore, in the wire stranding apparatus 10 and the method for manufacturing the stranded wire 9 of the present embodiment, the manufacturing speed of the stranded wire 9 can be increased by increasing the moving speed of the core wire 13 and the revolving speed of the spools 31 about the core wire 13 while making the degree of stranding uniform.

Further, since the wire speed obtaining auxiliary mechanism 50 includes the speed detection pulley 52 around which the wire 32 to be wound on the core wire 13 is routed and the rotary encoder 54 configured to detect the rotating speed of the speed detection pulley 52, the rotating speed of the speed detection pulley 52 used to obtain the speed of the wire 32 to be wound on the core wire 13 can be relatively inexpensively and easily detected. Furthermore, since the wire speed obtaining auxiliary mechanism 50 includes the auxiliary pulley 53 around which the wire 32 routed around the speed detection pulley 52 is further routed and the elastic body 56 configured to bias the auxiliary pulley 53 in the direction away from the speed detection pulley 52, the wire 32 can be routed around the speed detection pulley 52 with a predetermined tension and the speed of the wire 32 can be accurately obtained by preventing the wire 32 from slipping with respect to the speed detection pulley 52.

It should be noted that although the servo motor 40 has been provided as the rotation driving mechanism in the above embodiment, the rotation driving mechanism is not limited to the servo motor as long as being capable of rotating the spool 31. For example, a fluid pressure motor may be provided which can rotate the spool 31 by a fluid pressure of compressed air or the like.

Further, although a case where the stranded wire 9 having the six wires 32 spirally wound around the core wire 13 is obtained has been described in the above embodiment, the number of the wires 32 to be spirally wound around the core wire 13 may be three, four, five, seven or more without being limited to six.

Further, although a case where the obtained stranded wire 9 is wound and stored on the drum 91 constituting the collecting device 90 has been described in the above embodiment, the obtained stranded wire 9 may not necessarily be stored. For example, the obtained stranded wire 9 may be directly supplied to an unillustrated wire winding machine and immediately used for winding by the wire winding machine.

Further, although a case where the speed of the wire 32 to be wound on the core wire 13 is obtained using the wire speed obtaining auxiliary mechanism 50 including the speed detection pulley 52 and the rotary encoder 54 configured to detect the rotating speed of the speed detection pulley 52 has been described in the above embodiment, there is no limitation to the use of the wire speed obtaining auxiliary mechanism 50 configured to detect the rotating speed of the speed detection pulley 52 as long as the speed of the wire 32 to be wound on the core wire 13 can be obtained. For example, a wire speed detection sensor may be used which directly measures the speed of the wire 32 in a non-contact manner using laser light.

Further, although a case where the wire speed obtaining auxiliary mechanism 50 is provided in each revolving body 23 has been described in the above embodiment, the wire speed obtaining auxiliary machine 50 needs not be provided in each revolving body 23 and may be mounted on another part as long as the speed of the wire 32 to be wound on the core wire 13 can be obtained. For example, wire speed obtaining auxiliary mechanisms 100 may be provided on the tip side supporting plate 22 provided on the tip side of the shaft member 11 as shown in FIG. 6.

Figure 6:
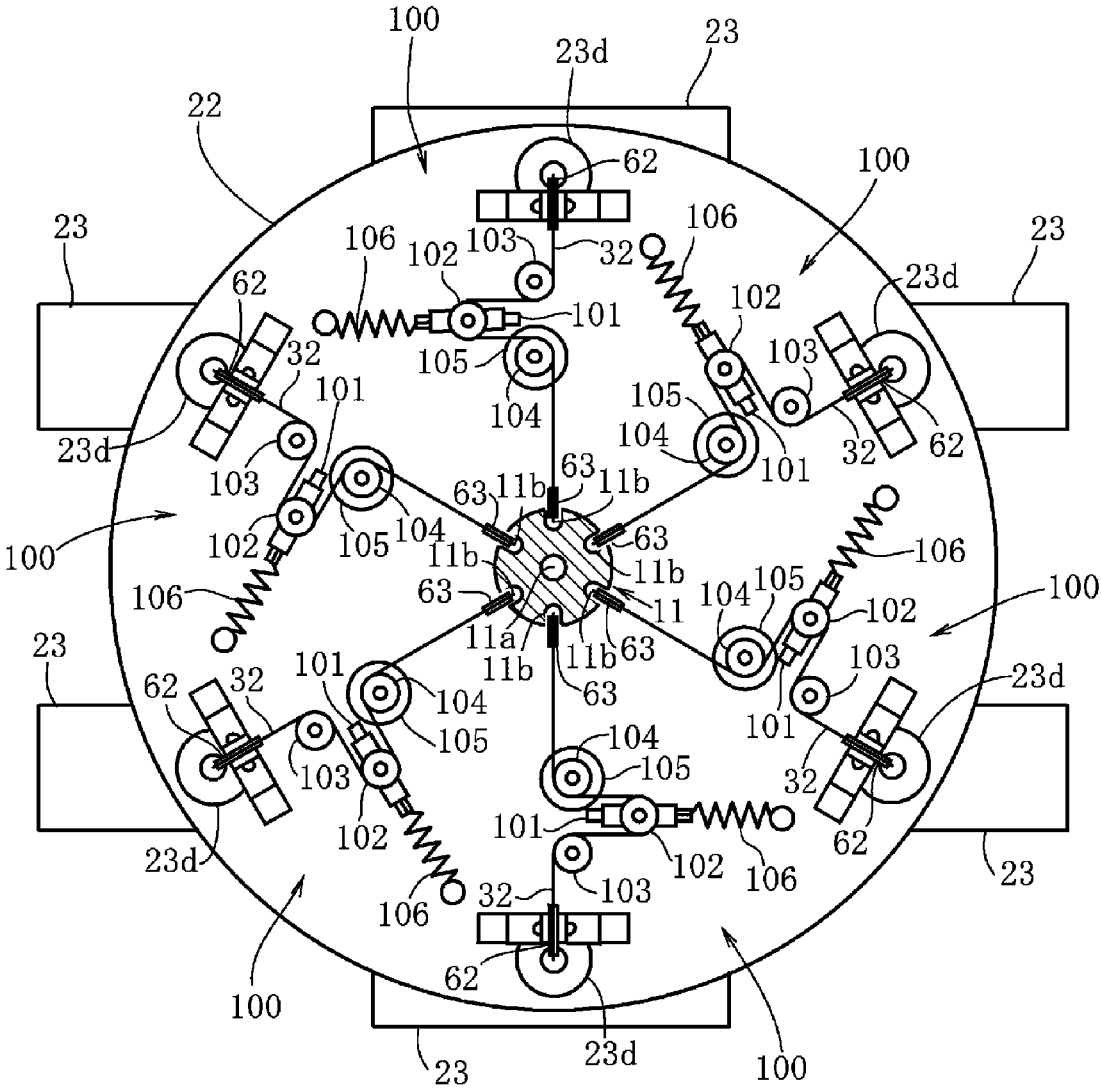
FIG. 6 is a view, corresponding to FIG. 5, showing other wire speed detection mechanisms.

The wire speed obtaining auxiliary mechanism 100 shown in FIG. 6 includes a rail 101 extending in a direction perpendicular to the wire 32 between the first and second turning pulleys 62, 63 and provided on the tip side supporting plate 22, an auxiliary pulley 102 movably and rotatably supported on the rail 101, a third turning pulley 103 provided on the tip side supporting plate 22 to turn the wire 32 from the first turning pulley 62 toward the auxiliary pulley 102, a speed detection pulley 104 configured to turn the wire 32 folded at the auxiliary pulley 102 toward the second turning pulley 63 again, a rotary encoder 105 configured to detect a rotating speed of the speed detection pulley 104 and an elastic body 106 configured to bias the auxiliary pulley 102 in a direction to separate the auxiliary pulley 102 from both the third turning pulley 103 and the speed detection pulley 104.

The wire 32 unwound from the spool 31 and passed through the pivoting member 23*d* is turned by the first turning pulley 62 to move toward the core wire 13 and further turned toward the auxiliary pulley 102 at the third turning pulley 103. The wire 32 turned at the third turning pulley 103 is routed around the auxiliary pulley 102 and folded, moves toward the speed detection pulley 104 and, after being routed around the speed detection pulley 104, moves toward the nozzle 11*b* of the shaft member 11.

In the wire speed obtaining auxiliary mechanism 100 shown in FIG. 6, the rotating speed of the speed detection pulley 104 around which the wire 32 near the nozzle 11*b* is routed is detected by the rotary encoder 105, whereby the wire speed obtaining unit 8*a* of the controller 8 can obtain the winding speed of the wire 32 and the winding speed of the wire 32 can be relatively inexpensively and easily obtained.

Then, the rotation driving mechanism control unit 8*b* of the controller 8 controls the rotation of the spool 31 feeding the wire 32 such that the speed of the wire 32 to be wound on the core wire 13 has a predetermined value, whereby a length of the wire 32 to be spirally wound on the core wire 13 per unit length can be prevented from changing and a uniform stranded wire 9 can be obtained.

Further, since the wire speed obtaining auxiliary mechanism 100 shown in FIG. 6 includes the auxiliary pulley 102 around which the wire 32 routed around the speed detection pulley 104 is further routed and the elastic body 106 configured to bias the auxiliary pulley 102 in the direction away from the speed detection pulley 104, the wire 32 can be routed around the speed detection pulley 104 with a predetermined tension and the speed of the wire 32 can be reliably detected by preventing the wire 32 from slipping with respect to the speed detection pulley 104.

Embodiments of this invention were described above, but the above embodiments are merely examples of applications of this invention, and the technical scope of this invention is not limited to the specific constitutions of the above embodiments.

This application claims priority based on Japanese Patent Application No. 2017-230293 filed with the Japan Patent Office on Nov. 30, 2017, the entire contents of which are incorporated into this specification.

The invention claimed is:

1. A wire stranding apparatus, comprising:

a core wire moving mechanism configured to move a core wire in an axial direction at a constant speed;

a spool configured to feed a wound wire by rotation;

a revolving mechanism configured to revolve the spool about the core wire;

a rotation driving mechanism configured to feed the wire by rotating the spool, the wire fed from the spool being spirally wound on an outer periphery of the core wire by revolution of the spool, wherein the core wire moves in the axial direction; and a control device including a wire speed obtaining unit configured to obtain a speed of the wire to be wound on the core wire and a rotation driving mechanism control unit configured to control the rotation driving mechanism such that the speed of the wire obtained by the wire speed obtaining unit has a predetermined value.

2. The wire stranding apparatus according to claim 1, further comprising:

a speed detection pulley, the wire to be wound on the core wire being routed around the speed detection pulley; and a rotary encoder configured to detect a rotating speed of the speed detection pulley, the wire speed obtaining unit is configured to calculate and obtain the speed of the wire on the basis of the rotating speed of the speed detection pulley detected by the rotary encoder.

3. The wire stranding apparatus according to claim 2, further comprising:

an auxiliary pulley, the wire routed around the speed detection pulley being further routed around the auxiliary pulley; and an elastic body configured to bias the auxiliary pulley in a direction away from the speed detection pulley.

4. A method for manufacturing a stranded wire, comprising a winding step of spirally winding a wire fed by rotation of a spool around a core wire by revolving the spool having the wire wound thereon about the core wire moving in an axial direction at a constant speed, wherein the winding step includes:

obtaining a speed of the wire to be wound on the core wire; and controlling the rotation of the spool such that the obtained speed of the wire has a predetermined value.

* * * * *